United States Patent [19]

Huang

[11] Patent Number: 4,976,753

[45] Date of Patent: Dec. 11, 1990

[54] SNAP-TOGETHER HOUSING FOR SMALL APPLIANCES

[75] Inventor: Jyh C. Huang, Cerritos, Calif.

[73] Assignee: Tatung Company of America, Inc., Long Beach, Calif.

[21] Appl. No.: 401,804

[22] Filed: Sep. 1, 1989

[51] Int. Cl.[5] ..... B03C 3/82; F16B 12/12

[52] U.S. Cl. ..... 55/124; 55/131; 55/140; 55/473; 55/490; 55/501; 312/107

[58] Field of Search ..... 55/124, 126, 131, 140, 55/141, 429, 467, 473, 490, 501, 511, DIG. 31; 62/262; 312/107, 111; 220/4 R, 4 B

[56] References Cited

U.S. PATENT DOCUMENTS

| | | | |
|---|---|---|---|
| 2,999,611 | 9/1961 | Paulson | 55/DIG. 31 |
| 3,357,763 | 12/1967 | Toper | 55/467 |
| 3,778,985 | 12/1973 | Daigle et al. | 55/511 |
| 3,861,894 | 1/1975 | Marsh | 55/473 |
| 3,950,157 | 4/1976 | Matney | 55/DIG. 31 |
| 4,522,574 | 11/1985 | Hotta | 55/501 |
| 4,541,847 | 9/1985 | Oie et al. | 55/124 |
| 4,607,500 | 8/1986 | Bolton et al. | 62/262 |
| 4,701,196 | 10/1987 | Delany | 55/DIG. 31 |
| 4,737,173 | 4/1988 | Kudirka et al. | 55/511 |
| 4,885,015 | 12/1989 | Goulet et al. | 55/DIG. 31 |

*Primary Examiner*—Jay H. Woo
*Assistant Examiner*—James P. Mackey
*Attorney, Agent, or Firm*—Gene W. Arant; Don C. Lawrence

[57] ABSTRACT

An applicance housing includes a box-like front part having a front panel and an open rear end, and a pair of symmetrical, box-like side parts, each having an open front end and an open medial side. The open medial sides of the two side parts snap together in coplanar abutment along a sagittal plane, and the open rear end of the front part then snaps onto the front ends of the two engaged side parts to form a closed housing. In an air cleaner embodiment, each of the two side parts is provided with a ventilated lateral side panel which is recessed to create a space for holding a sheet of filtering media, and a flush grill which snaps onto the side panels over the filters to hold them in place.

10 Claims, 5 Drawing Sheets

Fig. 4.
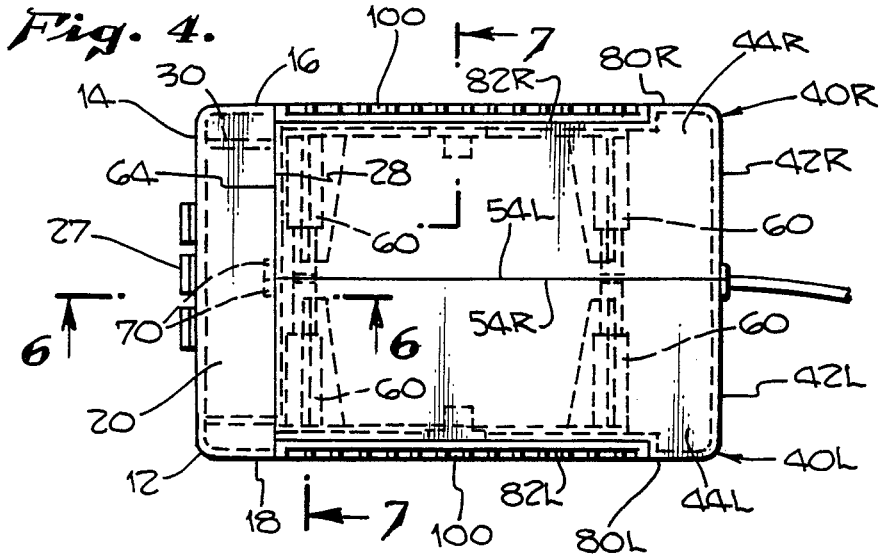
Fig. 5.
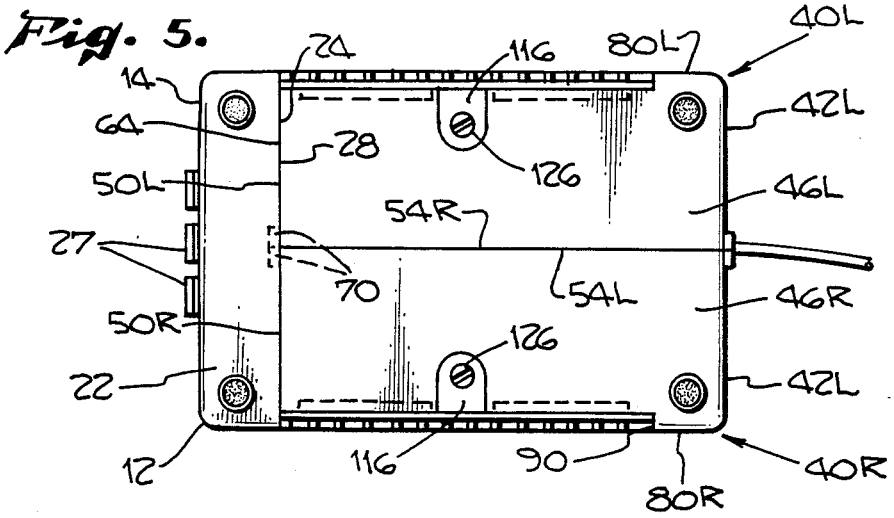
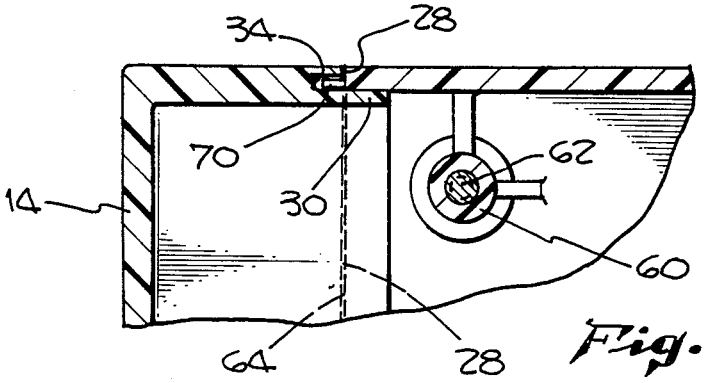
Fig. 6.

SNAP-TOGETHER HOUSING FOR SMALL APPLIANCES

BACKGROUND

1. Field of the Invention

This invention pertains to housings for small electrical appliances, and particularly, to a snap-together housing for an electronic air cleaner.

2. Description of the Related Art

Small electrical appliances intended for use in the home are usually provided with a housing which is inexpensive but which must also be functional, attractive in appearance, and safe during use. A typical small appliance having a requirement for such a housing is an electronic air cleaner.

An electronic air cleaner typically comprises, in addition to the afore-mentioned housing, a blower powered by an electric motor. The blower takes in room ambient air and passes it through filtering media contained within the housing before exhausting the filtered air back into the room.

The cleaner may also include means for scenting the air with a pleasant odor, as well as means for ionizing the air passing through it such that the ionized air, in turn, ionizes particles of dirt with which it comes into contact, thereby causing them to adhere to the walls and ceiling of the room or to the filtering media.

Finally, the cleaner must include some means for actuating the blower and selecting its speed, and for turning the oderizing and/or ionizing means on and off.

Thus, it may be seen that the components of a typical air cleaner can impose unique demands upon its housing relative to other types of appliances in terms of the manner in which their respective components are housed and held in working juxtaposition.

This invention discloses and claims a novel housing for a small electrical appliance that is particularly suitable for use with an electronic air cleaner as described above. The housing is easily and inexpensively manufactured and assembled, yet is light, compact, rugged, and safe in use.

SUMMARY OF THE INVENTION

The novel housing comprises a box-like front part having a plurality of panels, including a front panel and an open rear end, and a pair of box-like side parts which are generally symmetrical to each other about a sagittal plane through the middle of the front panel, each side part having a plurality of panels, an open front end, and an open medial side.

The open medial side of one of the two side parts has a medially-protruding lip extending around it inwardly of the edges of its panels. The lip is snapped laterally into the open medial side of the other side part in a tight, overlapping fit with interior surfaces of corresponding ones of the panels of the second side part and serves to hold the respective medial edges of the two side parts in abutment with each other along the sagittal plane, with corresponding ones of their respective panels coplanar.

The open rear end of the front part has a rearwardly-protruding flange extending around its rear edges edges inwardly of the edges. The flange is snapped rearwardly into the open front ends of the two engaged side parts in a tight, overlapping fit with inner surfaces of corresponding ones of their respective panels and serves to hold the rear edges of the front part in coplanar abutment with corresponding ones of the front edges of the two side parts, with corresponding ones of their respective panels coplanar.

In an embodiment particularly suited for use with an electronic air cleaner, each of the two side parts is provided with a lateral side panel which has a pair of exterior side surfaces, one of which is fenestrated for the passage of air through it and recessed medially of the other to create a space for holding a sheet of filtering media. The housing additionally comprises a pair of grills which snap onto the side panels in overlying relation to respective ones of the filter-receiving spaces and serve to retain the filters in place.

A better understanding of the housing and a greater appreciation of its many attendant advantages may be obtained from a consideration of the detailed description of its preferred embodiments which follows, particularly if the description is considered in conjunction with the accompanying drawings. The following is a brief description of the drawings.

BRIEF DESCRIPTION OF THE DRAWINGS

FIG. 4 is a view of the top of the housing, as seen along the lines 4—4 in FIG. 3;

FIG. 5 is a view of the bottom of the housing, as seen along the lines 5—5 in FIG. 3;

FIG. 6 is a larger-scale, partial vertical sectional view through the front part and right side part of the housing, as revealed by the section taken along the lines 6—6 in FIG. 4;

DETAILED DESCRIPTION OF THE PREFERRED EMBODIMENTS

Figures 1, 12:
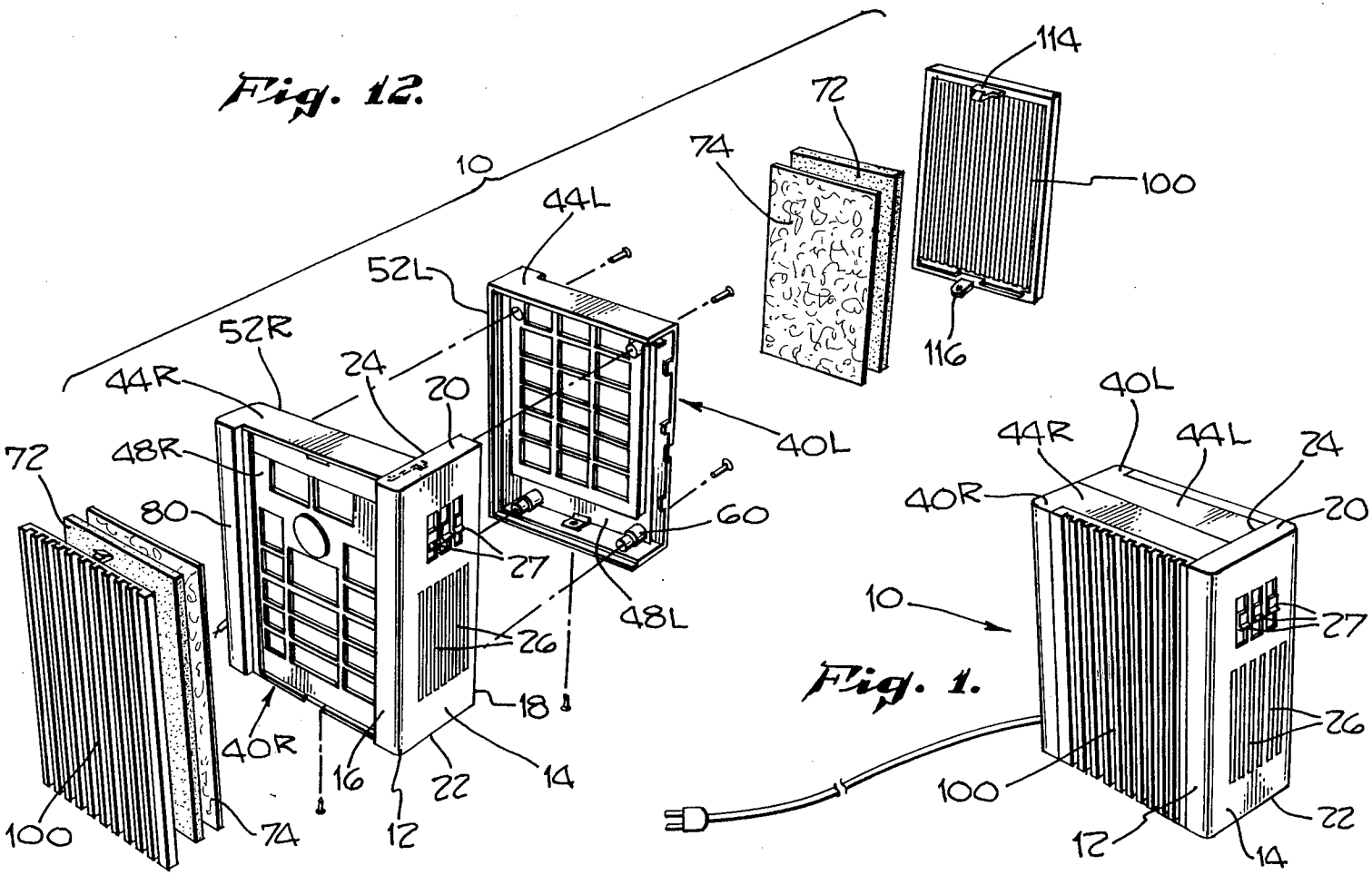
FIG. 1 is a reduced-scale, isometric perspective view of the housing of the present invention showing its front, top, and right side.
FIG. 12 is a reduced-scale, exploded isometric view of the housing.

In FIG. 1, a snap-together housing 10 particularly suitable for use in a home electronic air cleaner is illustrated perspectively in an assembled condition. FIG. 12 is another perspective view of the same housing 10 which reveals its various components in exploded form.

The housing 10 comprises a box-like front part 12 having a front panel 14, a right side panel 16, a left side panel 18, a top panel 20, a bottom panel 22, and an open rear end 24. In a preferred embodiment, the panels are joined at adjacent edges to form rounded, or full-radius corners.

In a form of the housing 10 used in an air cleaner, an electric squirrel-cage blower (not illustrated) is mounted internally of the housing with its exhaust outlet sealed against the rear surface of the front panel 14, and the front panel has a plurality of openings 26 extending through it in the front-to-rear direction for the passage of exhaust air from the blower. The front panel may optionally include a plurality of, e.g., slide switches 27 mounted on its front surface for controlling the components enclosed by the housing.

Figure 8:
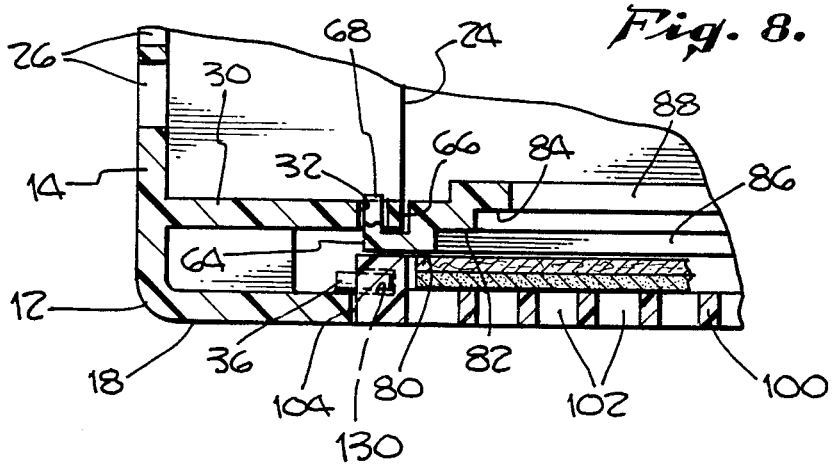
FIG. 8 is a partial horizontal sectional view through the front part and left side part and grill of the housing, as revealed by the section taken along the lines 8—8 in FIG. 2.

The top, bottom, and two side panels of the front part 12 have coplanar rear edges 28 and a rearwardly-protruding flange 30 extending around, and inwardly of, the edges (see FIGS. 6 and 8). In the preferred air cleaner housing illustrated, the walls of the flange 30 parallel to the two front part side panels 16,18 are spaced medially inward of respective ones of the two panels and have a plurality of slots 32 extending laterally through them (see FIG. 8).

Figure 2:
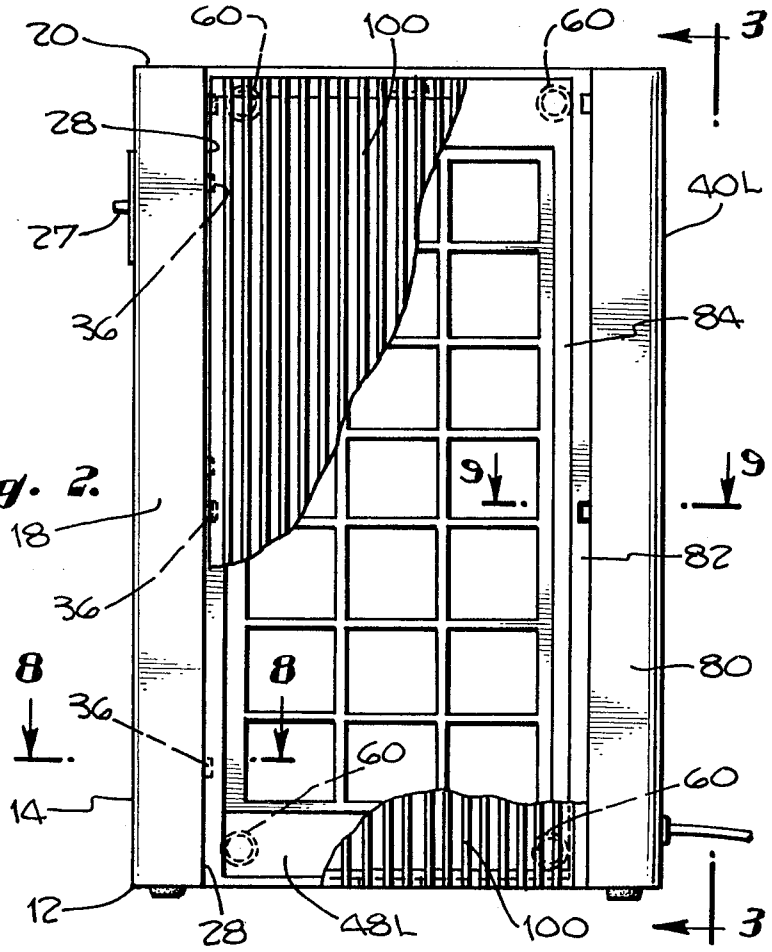
FIG. 2 is a larger-scale view looking into the left side of the housing, with the left grill of the housing partially cut away to show a plan view of the recessed surface on the side part adapted to receive an air filter below the grill.
Figure 3:
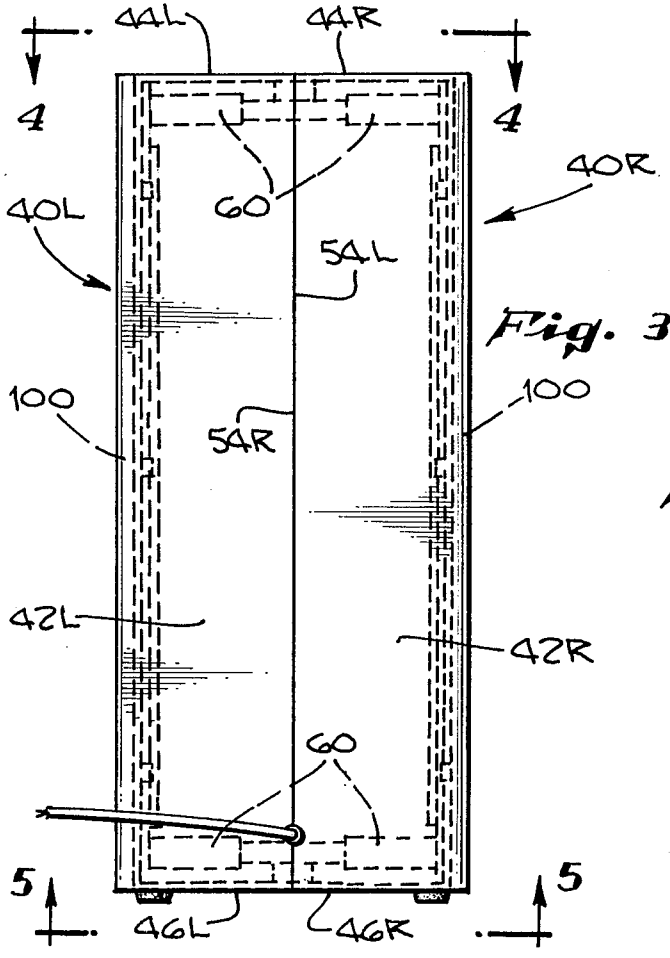
FIG. 3 is a view of the rear of the housing, as seen along the lines 3—3 in FIG. 2.

Each of the top and bottom panels 20,22 has an aperture 34 in its rear edge 28 which extends forwardly into the edge (see FIG. 6), and both of the two side panels have alignment pins 36 on their rear edges 28 protruding rearwardly (see FIGS. 2 and 8).

The housing 10 further comprises box-like right and left side parts 40R and 40L, respectively, which are generally symmetrical to each other about a sagittal plane through the front panel 14. Each side part 40R,40L has a rear panel 42R,42L, top panels 44R,44L, bottom panels, 46R,46L, a lateral side panel 48R,48L, an open front end 50R,50L, and an open medial side 52R,52L.

Figure 7:
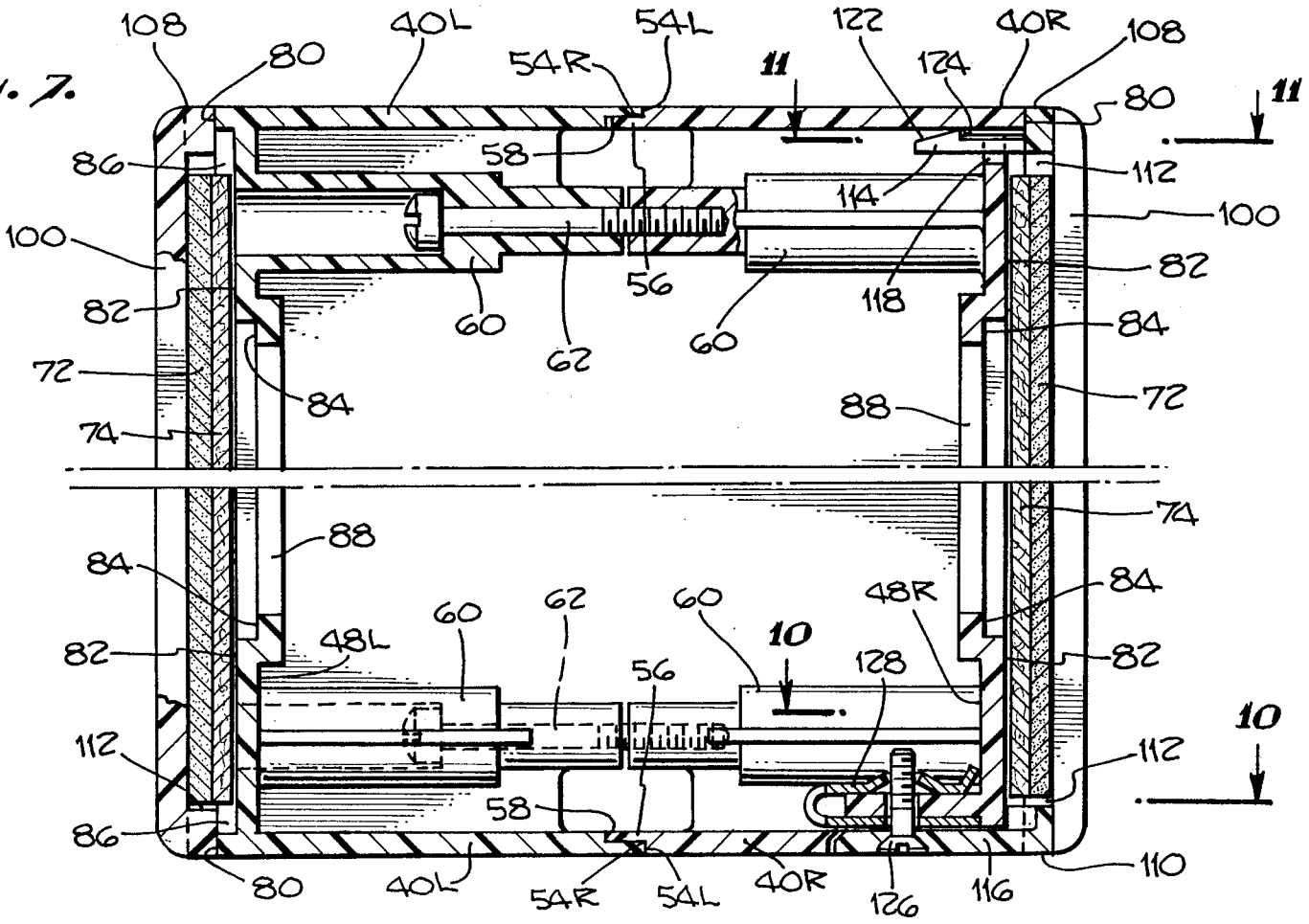
FIG. 7 is a shortened vertical sectional view through the housing looking toward the rear of its front panel, as revealed by the section taken along the lines 7—7 in FIG. 4, the portion of the housing between the two phantom lines having been omitted from the view.

In the preferred housing illustrated, the top, rear, and bottom panels of the right side part 40R have coplanar medial edges 54R and a medially-protruding lip 56 extending around, and inwardly of, the edges (see FIG. 7). The top, rear, and bottom panels of the left side part 40L also have coplanar medial edges 54L and a lateral recess 58 extending around, and inwardly of, the edges, the recess 58 being sized to slidingly receive the lip 56 on the first side part in a tight, overlapping fit. When the lip 56 is snapped into the recess 58 in the lateral direction, the medial edges 54R, 54L of the two side parts are held in abutment along the sagittal plane, with their respective top, bottom, and rear panels coplanar (see FIGS. 3,4,5 and 7).

To retain the two side parts in assembled abutment, the lateral side panels 48R, 48L of the two side parts 40R, 40L have interior surfaces with a plurality of medially-extending bosses 60 disposed on them in abutting, symmetrical pairs, one of each pair of the bosses having a fastener 62, such as a self-tapping screw, extending through it and into the other of the pair and holding the two side parts together in the medial direction (see FIG. 7).

The top, lateral side, and bottom panels of the two side parts 40R,40L have coplanar front edges 64 which, when the two side parts are assembled together, define a front opening 66 which is sized to slidingly receive the flange 30 on the rear of the front part 12 in a tight, overlapping fit (see FIGS. 6 and 8).

Each of the interior surfaces of the side panels 48R,48L has a plurality of medially-protruding locking fingers 68 disposed on it rearwardly of its respective front edge 64, the fingers having rounded, cam-like ends (see FIG. 8), and each of the front edges of the top and bottom panels 44R,44L and 46R,46L has an forwardly-protruding alignment tab 70 disposed on it (see FIGS. 4, 5 and 6).

The front part 14 is assembled to the two assembled side parts 40R,40L, by snapping the flange 30 on the rear of the front part rearwardly into the opening 66 defined by the front ends of the two engaged side parts, which serves to hold the rear edge 28 of the front part in coplanar abutment with the front edges 64 of the two side parts, with corresponding ones of their respective top, bottom, and side panels coplanar. The alignment tabs 70 on the top and bottom panels of the side parts then engage in respective ones of their corresponding apertures 34 in the rear edges of the top and bottom panels of the front part, and the locking fingers 68 on the lateral side panels of the two side parts engage with the slots 32 in the flange in a camming, over-center locking relationship and hold the three parts together (see FIGS. 6 and 8).

To filter the air passing through the air cleaner, relatively large areas of sheet-like filtering media are typically provided, such as the filter layers 72 and 74 shown in the figures in overlying, symmetrical pairs (see FIG. 12). The filter media layers 72 typically consist of sheets of non-woven plastic fiber material that is impregnated with activated carbon powder, and the filter layers 74 typically consist of a synthetic fiber material having electrical charges imbedded within it and sold under the name "Filtrete Media."

Figure 9:
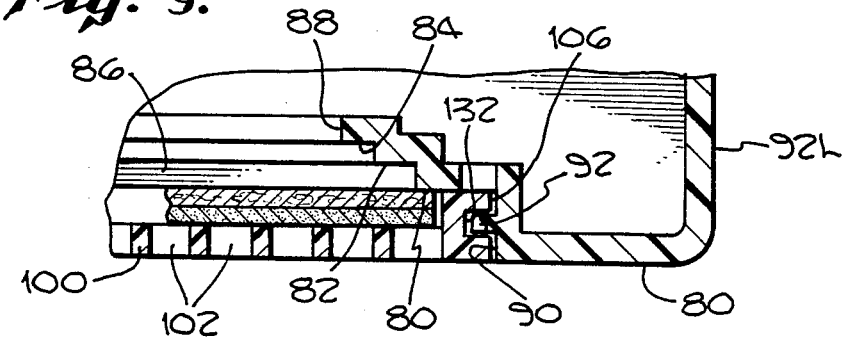
FIG. 9 is partial horizontal sectional view through the left side part and grill of the housing, as revealed by the section taken along the lines 9—9 in FIG. 2.

In order to accomodate the filtering media in the housing and dispose it advantageously at the intakes of the blower, each of the lateral side panels 48R,48L of each of the side parts has, in symmetrical pairs, a first exterior surface 80, with parallel second and third exterior surfaces 82 and 84, respectively, recessed medially inward of the first (see FIGS. 7,8 and 9). The third surfaces 84 are recessed medially inward of the second surfaces 82 and define portions of right and left air-filter-receiving spaces 86 between themselves and their respective second surfaces. The third surfaces 84 each have a plurality of openings 88 extending laterally through them and their respective adjacent side panels for the passage of air through them and into the blower intakes.

The first surfaces 80 have a medial step 90 extending between themselves and their respective second surfaces 82 forward of their respective rear panels 42R and 42L, each of the medial steps having an alignment pin 92 protruding forwardly from it (see FIG. 9).

The housing further comprises a pair of substantially identical air-filter-retaining grills 100, each grill being retained on a respective one of the two lateral side panel second exterior surfaces 82 in overlying relation to the filter-receiving space 86 disposed medially-inward thereof.

Each grill 100 has a plurality of openings 102 extending laterally through it for the passage of air through the filters and into the housing, and a front edge 104, a rear edge 106 (see FIGS. 8 and 9), a top edge 108, and a bottom edge 110 (see FIG. 7). Additionally, the grills each include an interior surface having a recess 112 inwardly of the edges which defines a second portion of the filter-receiving space 86 between the grill and the third exterior surfaces 84 and serves to retain the air filter media.

Figure 10:
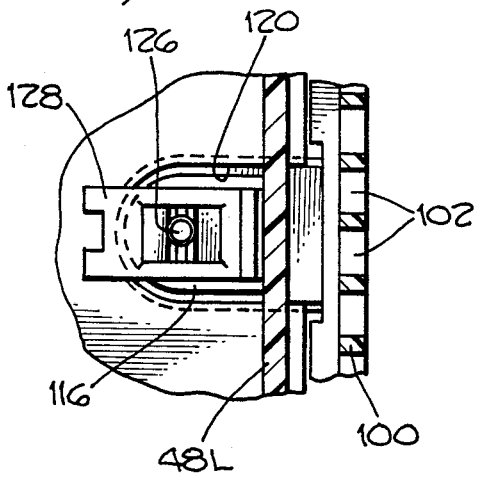
FIG. 10 is a partial horizontal sectional view through a first mounting tang and associated nut plate on the right grill of the housing, as revealed by the section taken along the lines 10—10 in FIG. 7.
Figure 11:
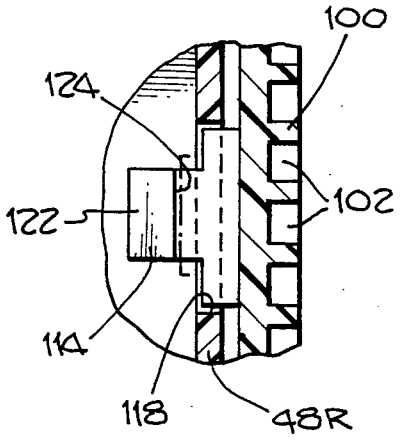
FIG. 11 is a partial horizontal sectional view through a second mounting tang on the right grill of the housing, as revealed by the section taken along the lines 11—11 in FIG. 7.

The top and bottom edges 108 and 110 of the grills are flush with a respective one of the top and bottom panels of a respective side part, and each top and bottom edge has an upper and a lower, medially-extending tang 114 and 116, respectively, engaging a corresponding slot 118 and 120, respectively, contained in a corresponding one of the two side parts (see FIGS. 10 and 11).

The upper one of the tangs 114 on each grill has a ramped end 122 and a following barb 124 engaging its corresponding slot 118 in a snap-in, over-center locking arrangement (see FIG. 7). The lower one of the tangs 116 on each grill has an aperture through it, with an associated fastener 126 extending through it and engaging a nut-plate 128 retained in the housing (see FIGS. 5,7 and 10).

The front edges 104 of the two grills are each flush with one of the front edges of a corresponding side panel and each has a first hole 130 in it engaging one of the rearwardly-extending alignment pins 36 on the rear edge of a corresponding front part side panel (see FIG. 8). The rear edges 106 of the grills are each held in abutment with a corresponding one of the the medial steps 90 in the side parts and contain a second hole 132 in them which engages the forwardly-protruding alignment pin 92 disposed thereon (see FIG. 9).

In the preferred embodiment of the housing 10 of the invention, each of its parts is injection-molded from a strong, light weight, and inexpensive thermoplastic material. Other modifications in terms of materials, methods of fabrication and assembly methods will suggest themselves to those skilled in the art, depending upon the particular problem at hand. Accordingly, the scope of the present invention should be limited only by the following claims.

What is claimed is:

1. A three-piece, snap-together appliance housing, comprising:

a box-like front part having a front panel, two side panels, top and bottom panels, and an open rear end; and first and second box-like side parts which are generally symmetrical to each other about a sagittal plane through the middle of the front panel, each side part having a rear panel, top and bottom panels, a lateral side panel, an open front end, and an open medial side, the first and second side parts each having a medial edge extending around a respective one of the open medial sides of each of the side parts generally coextensively with a respective one of the top, rear, and bottom panels of each of the side parts, and front edges extending around a respective one of the open front ends of each of the side parts generally coextensively with a respective one of the top, side, and bottom panels of each of the side parts, the first side part having a medially-protruding lip extending around the open medial side of the first side part generally coextensively with the top, rear, and bottom panels of the first side part and inboard of the medial edges of the first side part, the lip on the first side part being inserted laterally into the open medial side of the second side part in a tight, overlapping fit with interior surfaces of respective ones of the top, bottom, and rear panels of the second side part and holding respective ones of the medial edges of the first and second side parts in abutment along the sagittal plane, with corresponding ones of the top, bottom, and rear panels of the first and second side parts coplanar, the front part having rear edges extending around the open rear end of the front part coextensively with the top, bottom, and two side panels of the front part, and a flange extending around the open rear end of the front part inboard of the rear edges of the front part and protruding in a rearward direction, defined as the direction extending from the front panel of the front part and toward the open rear end of the front part, the flange on the front part being inserted rearwardly into the open front ends of the side parts in a tight, overlapping fit with inner surfaces of respective ones of the top, bottom, and lateral side panels of the first and second side parts and holding the rear edges of the front part in coplanar abutment with corresponding ones of the front edges of the first and second side parts, with corresponding ones of the top, bottom and side panels of the front part coplanar with corresponding ones of the top, bottom, and side panels of the first and second side parts.

2. The housing of claim 1, wherein the second side part has a lateral recess extending around the open medial side of the second side part generally coextensively with the top, bottom, and rear panels of the second side part and inboard of the medial edges of the second side part, the recess being adapted to receive the lip on the first side part in a tight, overlapping fit.

3. The housing of claim 1, wherein:

each of the interior surfaces of the side panels of the first and the second side parts has a plurality of medially-protruding locking fingers disposed on said interior surface rearwardly of a corresponding one of the front edges of the first and second side parts, the fingers having rounded, cam-like ends, and the flange on the front part has a plurality of corresponding slots extending laterally through said flange and disposed therein to receive and engage corresponding ones of the fingers in a camming, over-center locking engagement when the flange is inserted into the front ends of the first and second side parts.

4. The housing of claim 1, wherein:

each of the respective front edges along each of the top and bottom panels of each of the first and the second side parts has an alignment tab protruding from said front edge in a forward direction, defined as the direction opposite the rearward direction; and each of the respective rear edges along the top and bottom panels of the front part has a corresponding aperture disposed in said rear edge to receive a corresponding one of the tabs when the flange on the front part is inserted into the front ends of the side parts.

5. The housing of claim 1, wherein the interior surfaces of the side panels of the two side parts have a plurality of medially-extending bosses disposed on said interior surfaces in symmetrical pairs, one of each pair of the bosses receiving a fastener extending through the other of the pair to pull and hold the two side parts together in the medial direction.

6. The housing of claim 1, wherein the front panel of the front part has at least one opening through the panel in the rearward direction for the passage of air from the housing;

the lateral side panel of each side part has a first lateral exterior surface, with parallel second and third lateral exterior surfaces recessed medially inward of the first exterior lateral surface, the first lateral exterior surface having a medial step forward of the corresponding side part rear panel extending between the first lateral exterior surface and the second lateral exterior surface, the third lateral exterior surface being recessed medially of the second lateral exterior surface and defining an air-filter-receiving space between the second lateral exterior surface and the third lateral exterior surface, the third lateral exterior surface having a plurality of openings extending laterally through the third lateral exterior surface and a corresponding side part side panel for the passage of air into the housing; and the housing further includes a pair of substantially identical air-filtering-retaining grills, each grill having grill mounting means for retaining the grill on a respective one of the side panel second exterior lateral surfaces in overlying relation to the filter-receiving spaces disposed medially-inward thereof.

7. The housing of claim 6, wherein the grill mounting means comprise:

a pair of medially-extending tangs disposed at top and bottom edges of each grill to engage in corresponding slots contained within each side part, a top one of the tangs on each of the grills having a ramped end and a following barb to engage in a corresponding slot in a snap-in, over-center locking engagement, a bottom one of the tangs having an aperture through the tang for an associated fastener to engage the housing through the aperture.

8. The housing of claim 6, wherein:

each of the rear edges of the front part side panels has an alignment pin protruding from said rear edge in the rearward direction;

each of the medial steps in the side part first exterior surfaces has an alignment pin protruding forward from said medial step; and each grill has front edge flush with the front edge of a corresponding one of the side part side panels, and a rear edge in abutment with a corresponding one of the side part steps, each edge containing a hole to engage a corresponding one of the alignment pins.

9. A five-part, snap-together housing for an electronic air cleaner, comprising:

a box-like front part having a front panel, two side panels, top and bottom panels, and an open rear end, the front panel having at least one opening through it for the passage of air from the housing, the top, bottom, and two side panels of the front part having rear edges generally coextensive with the top, bottom and two side panels of the front part and a flange extending around, and inboard of, the rear edges of the front part, the flange protruding from the rear end of the front part in a rearward direction, defined as the direction extending from the front panel of the front part and toward the rear end of the part, and having a plurality of slots extending laterally through said flange, the rear edges of the top and bottom panels of the front part each having an aperture extending into the edges in a direction opposite the rearward direction, the rear edges of the two side panels of the front part each having an alignment pin protruding rearwardly from said rear edges;

first and second box-like side parts which are generally symmetrical to each other about a sagittal plane extending through about the center of the front panel of the front part, each side part having a rear panel, top and bottom panels, a lateral side panel, an open front end, and an open medial side, the top, rear, and bottom panels of the first side part having medial edges and a medially-protruding lip extending around, inboard of, and generally coextensively with, the medial edges of the first side part, the top, rear, and bottom panels of the second side part having medial edges and a lateral recess extending around, inboard of, and generally coextensively with, the medial edges of the second side part, the recess being sized to slidingly receive the lip on the first side part in a tight, overlapping fit, the lip on the first side part being inserted laterally into the recess in the second side part and holding the medial edges of the two side parts in abutment along the sagittal plane, with corresponding ones of the top, bottom, and rear panels of the first and second side parts coplanar, the lateral side panels of the two side parts having interior surfaces with a plurality of medially-extending bosses disposed on said interior surfaces in abutting, symmetrical pairs, one of each pair of the bosses having a fastener extending through it and into the other of the pair and holding the two side parts together in the medial direction, each of the top, lateral side, and bottom panels of each side part having front edges and a recess extending around, inboard of, and generally coextensively with, the front edges of each the side part, the recess being sized to slidingly receive the flange on the front part in a tight, overlapping fit, each of the interior surfaces of the side panels having a plurality of medially-protruding locking fingers disposed on the surface rearwardly of a respective front edge of a corresponding one of the side parts, the fingers having rounded, cam-like ends, each of the front edges of the top and bottom panels of each the side parts having an alignment tab disposed thereon and protruding forwardly from said front edge, the flange on the rear end of the front part being inserted into the recesses in the front ends of the two side parts and holding the rear edge of the front part in coplanar abutment with the front edges of the two side parts, with corresponding ones of respective top, bottom, and side panels of the front part and the two side parts coplanar, the alignment tabs on the top and bottom panels of the side parts being engaged in respective ones of corresponding apertures in the rear edges of the top and bottom panels of the front part, and the locking fingers on the lateral side panels of the two side parts being engaged with the slots in the flange on the front part in a camming, over-center locking relationship and holding the three parts together, the lateral side panel of each side part having a first lateral exterior surface, with parallel second and third lateral exterior surfaces recessed medially inward of the first lateral exterior surface, the first lateral exterior surface of each side part having a medial step forward of the rear panel of each side part, the medial step extending between the first surface and the second surface, the third lateral exterior surface of each side part being recessed medially inward of the second lateral exterior surface of each side part and defining an air-filter-receiving space between the second and third lateral exterior surfaces, the third lateral exterior surface of each side part having a plurality of openings extending laterally through said surface and a corresponding side panel of each of the side parts for the passage of air into the housing, each of the medial steps in each of the side parts having an alignment pin protruding forwardly from said step; and a pair of substantially identical air-filter-retaining grills, each grill being retained on a respective one of the two lateral side panel second lateral exterior surfaces in overlying relation to the filter-receiving spaces disposed medially thereof, each grill having a plurality of openings extending laterally through it for the passage of air into the housing, and having front, rear, top, and bottom edges, the top and bottom edges of each grill being flush with a respective one of the top and bottom panels of a respective side part, each top and bottom edge having a medially-extending tang engaging a corresponding slot contained in a corresponding one of the two side parts, a top one of the tangs on each grill having a ramped end and a following barb engaging a corresponding one of the slots in a snap-in, over-center locking arrangement, a bottom one of the tangs on each grill having an aperture through said tang, with an associated fastener engaging the housing through the aperture, the front edge of each said grill being flush with the front edge of a corresponding one of the side part side panels and having a first hole in it engaging one of the rearwardly-extending alignment pins on the rear edge of a corresponding front part side panel, the rear edge of each said grill being in abutment with a corresponding one of the medial steps in a corresponding one of the side parts and having a second hole in said rear edge engaging the forwardly-protruding alignment pin thereon.

10. The housing of claim 9, wherein the front part, the first and second side parts and the grills are injection-molded from a plastic material.

* * * * *